US007931569B2

(12) United States Patent
Del Monte

(10) Patent No.: US 7,931,569 B2
(45) Date of Patent: Apr. 26, 2011

(54) WEIGHTED TRAINING BELT FOR HOCKEY PLAYERS

(76) Inventor: Dion Del Monte, Mississauga (CA)

( * ) Notice: Subject to any disclaimer, the term of this patent is extended or adjusted under 35 U.S.C. 154(b) by 0 days.

(21) Appl. No.: 12/576,872

(22) Filed: Oct. 9, 2009

(65) Prior Publication Data

US 2010/0093504 A1 Apr. 15, 2010

Related U.S. Application Data

(60) Provisional application No. 61/105,553, filed on Oct. 15, 2008.

(51) Int. Cl.
*A63B 21/065* (2006.01)

(52) U.S. Cl. ..... 482/105; 473/446

(58) Field of Classification Search ..... 482/105; 473/446; 224/660, 663, 666, 674, 677, 678, 224/680, 681, 682, 684, 904; 2/319, 320
See application file for complete search history.

(56) References Cited

U.S. PATENT DOCUMENTS 4,180,261 A * 12/1979 Kolka ..... 482/105
4,907,729 A * 3/1990 Hess, III ..... 224/682
5,106,082 A * 4/1992 Moschetti et al. ..... 482/139
5,341,975 A * 8/1994 Marinescu ..... 224/666
5,445,303 A * 8/1995 Cawile, Jr. ..... 224/222
5,643,184 A * 7/1997 Toso ..... 602/19
5,797,823 A * 8/1998 Gouvis, II ..... 482/105
6,039,677 A * 3/2000 Spletzer ..... 482/105
7,201,299 B2 * 4/2007 Forsman ..... 224/148.2
7,458,751 B2 * 12/2008 Carmichael ..... 405/186
2008/0280737 A1 * 11/2008 Cook ..... 482/105

* cited by examiner

*Primary Examiner* — Rinaldi I Rada
*Assistant Examiner* — Andrew M Tecco
(74) *Attorney, Agent, or Firm* — Elias Borges

(57) ABSTRACT

An improved weighted training belt for hockey players consisting of an elongated belt having a length, opposite first and second ends, and complimentary first and second coupling members provided on the first and second ends of the belt, respectively. The belt also includes at least one pair of connector elements positioned between the first and second coupling members, said pair of connector elements being movable along the length of the belt and selectively fixable at any point along the length of the belt. The training belt further includes at least one weight pouch having opposite side straps with a connector element provided on an end of each of the side straps, the connector elements of the weight pouch being complimentary to the pair of connector elements on the belt, the weight pouch configured to support at least one weight, the opposite side straps of the weight pouch each having an adjustable length.

20 Claims, 9 Drawing Sheets

WEIGHTED TRAINING BELT FOR HOCKEY PLAYERS

CROSS REFERENCE TO RELATED APPLICATION

This application claims priority from U.S. provisional application No. 61/105,553 filed Oct. 15, 2008 which is incorporated herein by reference.

FIELD OF THE INVENTION

The present invention relates to belts in general and to weighted belts in particular. Specifically, the invention relates to a weighted training belt assembly which can be worn on top of or integrated into the protective pants worn by hockey players.

BACKGROUND OF THE INVENTION

Weighted belts are generally well known and are used in a variety of applications ranging from strength training and muscular therapy to scuba diving and skydiving.

Used for fitness purposes, there are two main benefits to using weighted belts. First, they offer a form of resistance training where the user's (leg) muscles are overloaded, forcing them to work harder than usual in order to stimulate muscle growth. Secondly, weighted belts can aid in the development of muscle memory because the user is often able to perform repetitious, sport-specific exercises while wearing the belt. Muscle memory allows an athlete to perform complex skills and techniques with proficiency.

A training tool which provides these two benefits simultaneously would be particularly useful within the hockey community where a player's leg strength and skating technique play a large role in his success. Weighted belts specifically designed for hockey players do not exist in the prior art although the advantages of using such a training tool would be significant.

Belts for fitness training, scuba diving and load lifting among others, have been disclosed which provide a means of adding weight to a belt in addition to those other features required by the intended user. However, these belts fall short in delivering all the features specifically required by an athlete playing the sport of hockey. Because of the high speed, full-contact nature of hockey every minor disturbance or distraction to a player on the ice can negatively affect performance, reduce comfort and/or raise the risk of injury. For example, a player who is thrown off balance by a weight belt with a poor weight distribution pattern is less likely to properly execute required skills and less likely to be able to safely avoid collisions or dangerous falls while playing. Clearly, an athlete involved in a high speed, full-contact sport like hockey requires a belt with a different set of features than an athlete in a sport like scuba diving. An overview of the related prior art will prove illustrative of the limitations such belts face as regards their suitability for use during on-ice, hockey training.

U.S. Pat. Nos. 3,808,824 to Johnston et al and 6,113,521 to Winston disclose belts which typically use materials (like solid metal weights or weights with a rigid shape) which are not appropriate for hockey because they could cause injury if there were a fall or collision on the ice.

U.S Patent No. 2007/0099774 to Lampel and U.S. Pat. No. 5,076,575 to Eylander each disclose belts with a plurality of pockets for receiving weights which are distributed along the sides and back of the belt. However, distributing weight across a hockey player's back can cause unnecessary strain on the back muscles and negatively affect balance and skating technique.

U.S. Pat. No. 5,106,082 to Moschetti and U.S. Pat. No. 5,064,108 to Headley disclose belts which provide straps which may be used to attach a load to the belt. However, neither belt provides weights or suitable pouches for containing the weights. If the weight pouches aren't adequately supported and safely secured on the waist of a player, the training weight will shift position during use negatively affecting balance, hindering performance and raising the risk of injury.

U.S. Pat. No. 5,205,672 to Stinton discloses a load-bearing belt which allows the user to attach weight to the belt through the use of an securing mechanism which can be added to the belt. The weight is fastened to the securing mechanism by way of a flexible cord which is threaded between the weight and the securing mechanism. While such an arrangement allows for quick release of the weight by pulling the cord, there is no quick or convenient way to add the weight to the belt once the cord has been pulled. The belt must be removed and the cord again threaded between the weight and securing mechanism before the belt can be used again. A useful training tool for hockey players would allow for the user to quickly and conveniently add and remove weight from the belt so as to interrupt training as little as possible.

Belts such as those disclosed in U.S. Pat. Nos. 4,732,305 to Courtney et al., 6,146,053 to Nelson and 6,132,142 to Carmichael are constructed such that the belt passes through a sleeve or channel on each weight pouch so that the weight pouches essentially hang from the belt once it is fastened around the waist of the user. While the weights themselves may be added or removed quickly with belts constructed in this manner, the pouches containing the weights cannot be removed without completely removing the belt from the user's waist. Additionally, belts constructed such that the weight pouches hang from the belt allow the training weight to move around or sag on the belt when the user makes a sudden movement or changes direction quickly. Ideally the pouches would offer more support to prevent sagging and the pouches could be removed as quickly and easily as the weights themselves.

None of the disclosed belts discussed above have been specifically designed to work together with the protective pants worn by hockey players. Therefore, they do not take into account the positioning, size and shape of the plastic and foam protective padding contained within a typical hockey player's pants. Although substantial protection is provided by the pants to a player's lower torso, hips and thighs, gaps in the padding do exist to allow a player greater mobility and range of motion. In particular, comparatively little padding is offered around the waist so as not to restrict a player's ability to bend over. The waist area then—the area which belts occupy—is vulnerable if precautions are not taken. Any force on the belt (and therefore on the player) caused by a fall or collision which is not transferred away from the waist of the player may result in injury. Belts not designed to work with the curved forms of the protective padding built into hockey pants will not sit properly on top of the pants and are therefore less likely to safely and effectively transfer the force of any impact onto the protective padding. Ideally, the belt would provide some means of transferring the forces on the belt in the waist area resulting from a fall or collision onto the padding of the protective pants.

As prior art fails to provide a belt which satisfactorily offers the secure fit, proper weight distribution, ease of use and optimal safety features necessary in order to provide a beneficial and practical training stimulus to an athlete playing the sport of ice hockey, there exists a need in the art for a belt or similar assembly which can fulfill the specific on-ice training needs of a hockey player.

SUMMARY OF THE INVENTION

The present invention discloses a weighted training belt to be used by hockey players while training on ice as means to increase the resistance experienced while skating so as to effectively and conveniently train those muscles specifically required to skate without compromising player safety, comfort or performance. In accordance with this broad aspect, the invention provides a hockey training belt for adding a plurality of weights to a person's waist. The training belt includes an elongated belt having a length, opposite first and second ends, and complimentary first and second coupling members provided on the first and second ends of the belt, respectively. The belt also includes at least one pair of connector elements positioned between the first and second coupling members, said pair of connector elements being movable along the length of the belt and selectively fixable at any point along the length of the belt. The training belt further includes at least one weight pouch having opposite side straps with a connector element provided on an end of each of the side straps, the connector elements of the weight pouch being complimentary to the pair of connector elements on the belt, the weight pouch configured to support at least one weight, the opposite side straps of the weight pouch each having an adjustable length.

In accordance with another aspect of the present invention, there is provided a hockey training belt which includes an elongated belt having opposite first and second ends, with complimentary first and second coupling members provided on the first and second ends of the belt, respectively. The belt includes a left and right pair of quick connect couples positioned between the first and second coupling members, the left and right pair of quick connect couples being movably adjustable on the belt and selectively fixable anywhere along the length of the belt. The training belt further includes a right weight pouch having opposite side straps each of which has a quick connect coupling provided at one end. The quick connect couplings of the right pouch are complimentary to the right pair of quick connect couples on the belt. The right weight pouch also has an opening for containing one or more weights. The opposite side straps of the right weight pouch are configured such that their lengths are selectively adjustable. The training belt further includes a left weight pouch having opposite side straps each having a quick connect coupling at one end. The quick connect couplings of the left pouch are complimentary to the left pair of quick connect couples on the belt. The left weight pouch has an opening for containing one or more weights, and the opposite side straps of the left weight pouch have adjustable lengths.

In accordance with another aspect of the present invention, there is provided a hockey training belt which consists of an elongated belt having complimentary coupling members on each end. The belt also includes a left and right pair of connector elements positioned between the coupling members, the left and right pair of connector elements being movably adjustable along the length of the belt and selectively fixable at any point along the length of the belt. The training belt also includes a right weight pouch having opposite side straps, each side strap having a connector element which is complimentary to the right pair of connector elements on the belt. The right weight pouch is configured to support at least one weight and the lengths of the opposite side straps of the right weight pouch being adjustable. The training belt further includes a left weight pouch having opposite side straps with a connector element provided at each end, the connector elements of the left pouch being complimentary to the left pair of connector elements on the belt. The left weight pouch is configured to support at least one weight. Also, the opposite side straps of the left weight pouch are each configured to have an adjustable length.

In accordance with another aspect of the present invention, there is provided a hockey training belt as described above wherein the weight pouches further include a rigid member positioned between the weights and the belt.

In accordance with another aspect of the present invention, there is provided a hockey training belt as described above wherein the rigid member has a concave side oriented towards the belt.

In accordance with another aspect of the present invention, there is provided a hockey training belt wherein the weights contained in the pouches are flexible. The pouch is further configured to support the weights in a substantially vertical orientation when the hockey training belt is worn.

In accordance with another aspect of the present invention, there is provided a hockey training belt as described above wherein the pouches are configured to be resiliently deformable (i.e. stretchy) to permit the pouch to resiliently deform to accommodate the weights contained in the pouch.

In accordance with another aspect of the present invention, there is provided a hockey training belt as described above for use with protective hockey pants including those having kidney and hip protection pads separated by a gap at the waist. The rigid member of the pouches being dimensioned and configured to span the gap when the belt is worn over or integrated into the protective hockey pants.

In accordance with another aspect of the present invention, there is provided a hockey training belt as described above which can be integrated into the protective pants worn by hockey players.

BRIEF DESCRIPTION OF THE DRAWINGS

The preferred embodiments of the present invention shall now be described in drawings, wherein.

DESCRIPTION OF THE PREFERRED EMBODIMENTS

Figure 1A:
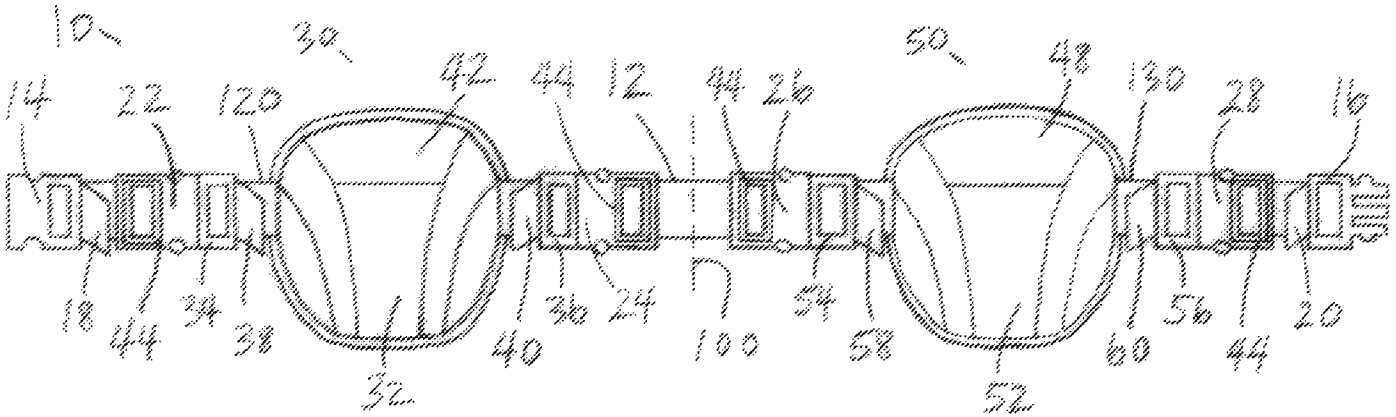
FIG. 1*a* is a front elevational view of the exterior side of a weighted training belt assembly made in accordance with the present invention with weight pouches attached.
Figure 1B:
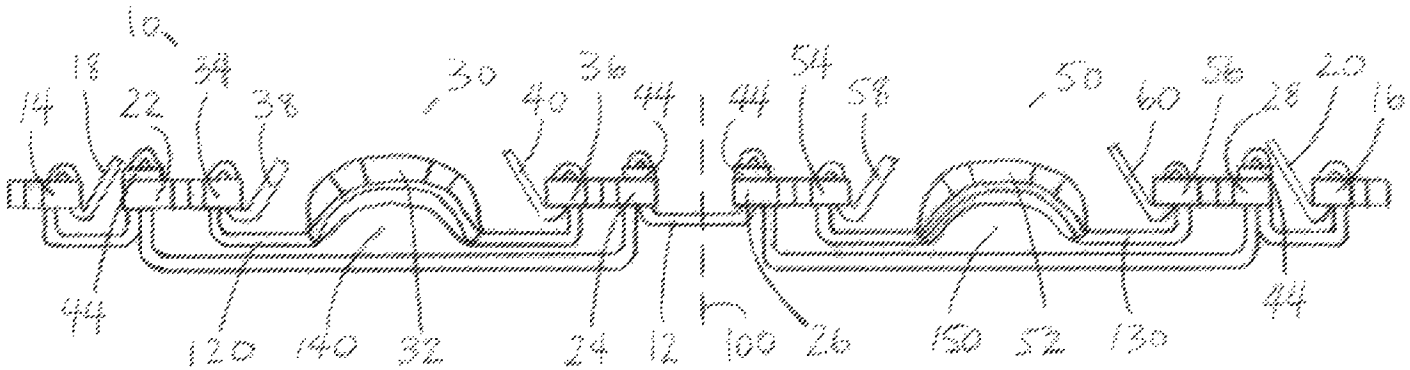
FIG. 1*b* is an elevational view from below of the weighted training belt made in accordance with the present invention with weight pouches attached.

Referring firstly to FIGS. 1*a* and 1*b* a training belt made in accordance with the present invention is shown generally as item 10 and includes a base belt 12 having opposite ends. Base belt 12 is preferably made of a flexible nylon webbing or the like. Contained on the opposite ends of base belt 12 is a pair of complimentary first and second coupling members, namely female receiving member 14 and male insertion member 16. Preferably, female receiving member 14 and male insertion member 16 combine to form a side release buckle hereinafter called Central Buckle. The Central Buckle shall be considered to sit at the front of the base belt and the midpoint 100 of the base belt shall be considered at the back. The end 18 of the base belt 12 which extends past the female receiving member 14 and the end 20 of the base belt 12 which extends past the male insertion member 16 can each be used to tighten and properly secure the base belt 12 around the user's waist once the Central Buckle has been fastened. This is achieved by pulling said base belt ends 18, 20 away from the Central Buckle.

Two pairs of connector elements or anchoring devices are additionally contained on said base belt 12 between the opposite ends of the belt. In the embodiment displayed in FIGS. 2*a* and 2*b*, said connector elements consist of four female receiving members 22, 24, 26, 28. Some or all of said female receiving members could however also be, in other embodiments, male insertion members, D- or O-ring attachments or other fasteners which enable each weight pouch strap 120, 130, seen in FIGS. 3*a*, 3*b*, 3*c*, 3*d*, to be fastened to the base belt 12. Connector elements 22, 24, 26 and 28 are movably adjustable along the length of base belt 12; however, limit clips 44 may be placed immediately adjacent said connector elements for the purpose of fixing (i.e. locking) said connector elements in a position on the base belt of the user's choosing thereby preventing said connector elements from inadvertently sliding along the base belt. Hook and loop tape or other means of preventing some or all of said connector elements from sliding along the base belt may also be used.

Figures 2A, 2B, 3A, 3B, 3C, 3D:
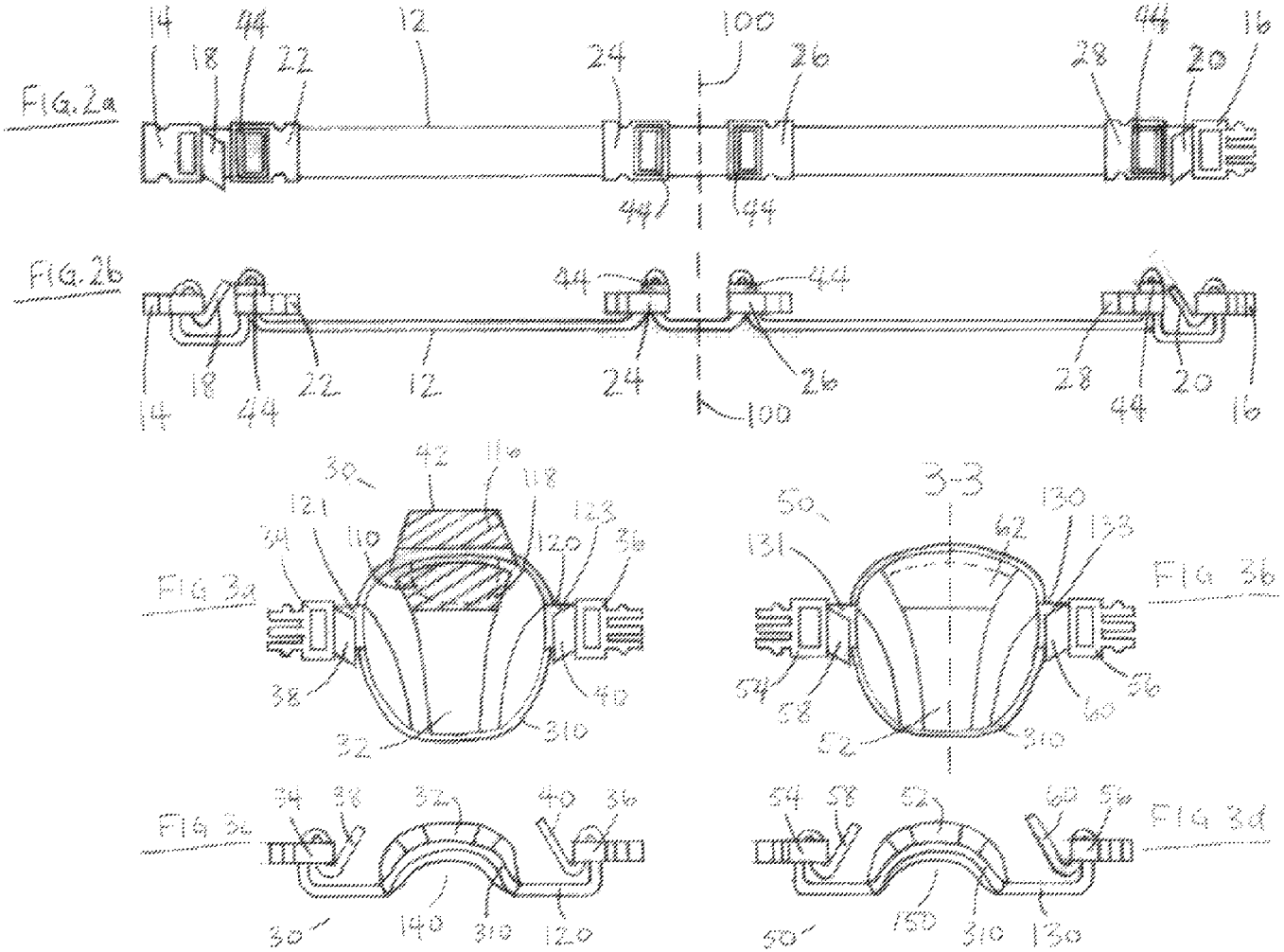
FIG. 2*a* is front elevational view of the exterior side of the base belt used in the weighted training belt assembly made in accordance with the present invention without weight pouches attached.
FIG. 2*b* is an elevational view from below of the base belt used in the weighted training belt assembly made in accordance with the present invention without weight pouches attached.
FIG. 3*a* is a front elevational view of the left weight pouch portion of the training belt made in accordance with the present invention showing the flap open.
FIG. 3*b* is a front elevational view of the right weight pouch portion of the training belt made in accordance with the present invention showing the flap closed.
FIG. 3*c* is an elevational view from below of the left weight pouch portion of the training belt made in accordance with the present invention.
FIG. 3*d* is an elevational view from below of the right weight pouch portion of the training belt made in accordance with the present invention.

Both straps 120 and 130 in the preferred embodiment displayed in FIGS. 3*a* and 3*b* are comprised of nylon webbing or similar and combine with a pouch 32, 52 to form what is hereinafter called a Weight Pouch 30, 50. Each of said straps 120, 130 are combined with said pouches 32, 52 such that Weight Pouch 30 has opposite side straps 121 and 123 with ends 38, 40 and Weight Pouch 50 has opposite side straps 131 and 133 with ends 58, 60. These opposite side straps extend out on either side of said pouches 32, 52. Each of said pouches 32, 52 contain one or more pockets 110 (see FIG. 9*c*), for containing the training weights 114 (see FIG. 9*d*) and a flap 42, 62 secured by hook 116 and loop 118 fastener or similar, preventing said training weights from unintentionally coming loose. Each of the opposite side straps 121, 123, 131 and 133 have connector elements adjacent their ends. In the embodiment illustrated, the connector elements consist of male insertion members 34, 36, 54, 56 which are attached a short distance away from ends 38, 40, 58, 60 of said straps 120, 130 each facing away from said pouches 32, 52. Said male insertion members could also be four female receiving members, a strap with hook and loop fasteners attached which threads through an O- or D-ring on the base belt and returns to lock on the strap of the weight pouch, or any other means of fastening said weight pouch to said base belt 12 so long as said four male members correspond with said four female members located on the base belt 12. Said four male insertion members correspond with said four female receiving members 22, 24, 26, 28 which are not contained in the Central Buckle but which are attached to the base belt 12 as means to fasten Weight Pouches 30, 50 to the base belt 12.

Figure 4A:
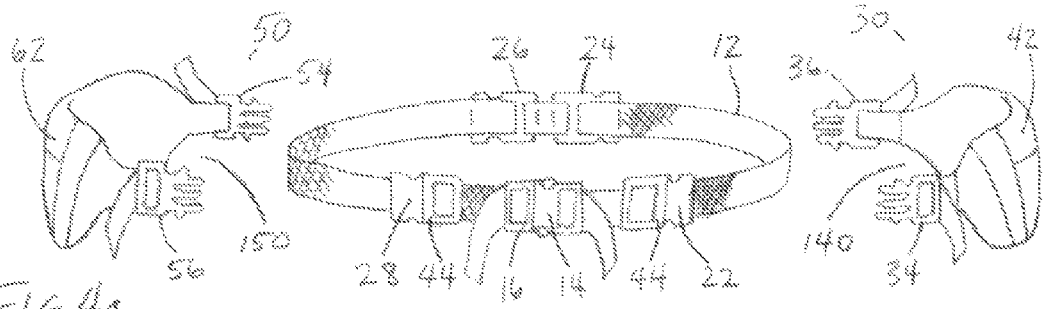
FIG. 4*a* is a perspective view from the front of the base belt portion of the present invention showing the weight pouches before the pouches are attached.
Figure 4B:
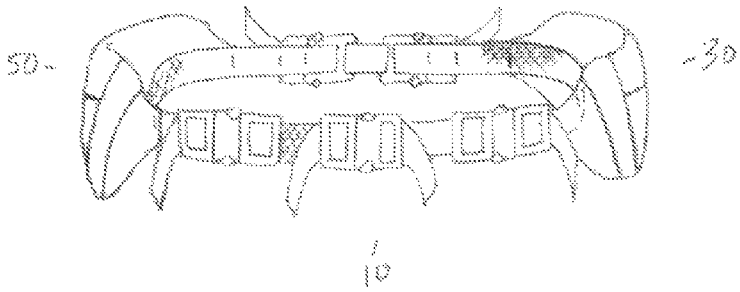
FIG. 4*b* is a perspective view from the front of the full weighted training belt assembly of the present invention with weight pouches attached.

Each male insertion member 38, 40, 58, 60 contained on said straps 120, 130 of said Weight Pouches 30, 50 is fastened in turn to a corresponding female receiving member 22, 24, 26, 28 attached to the base belt 12 such that the curve 140, 150 of each said Weight Pouch 30, 50 follows the curve of the waist belt 12 once it is fastened around the waist of the user, (as shown in FIG. 4*a* and FIG. 4*b*) and such that the flaps 42, 62 which allow the training weights 114 to be inserted into the pouches 32, 52 are at the top of each said Weight Pouch 30, 50 once the belt is attached to the user. In this way is said Weight Pouch 30, 50 fastened to said base belt 12.

FIGS. 1*a* and 1*b* show the weighted training belt assembly 10 with Weight Pouches 30, 50 attached. With the base belt 12 securely fastened to the waist of the user and said Weight Pouches 30, 50 attached to said base belt 12, the ends 38, 40, 58, 60 of the straps 120, 130 on each Weight Pouch can be used to precisely adjust the position of the Weight Pouches 30, 50 on the hips and hockey pants of the user. This is done by pulling each end 38, 40, 58, 60 of said strap 120,130 as required, in the direction of the weight pouch to which it is connected.

FIGS. 3*c* and 3*d* shows how the Weight Pouches 30, 50 are curved in shape so as to form to the curves of the user thereby keeping the training weight as close to the body of the user as possible FIGS. 4*a* and 4*b* show a perspective view of the weighted training belt assembly before and after the Weight Pouches are attached. The curve of the belt is matched by the curve of the Weight Pouches. In this embodiment, the belt could be worn over a pair of protective hockey pants (not shown). Small clips or hooks (not shown) may be provided on the base belt to allow the user to attach the belt to a fixed point on the pants themselves to prevent the belt from rotating on the hips of the user.

Figure 5A:
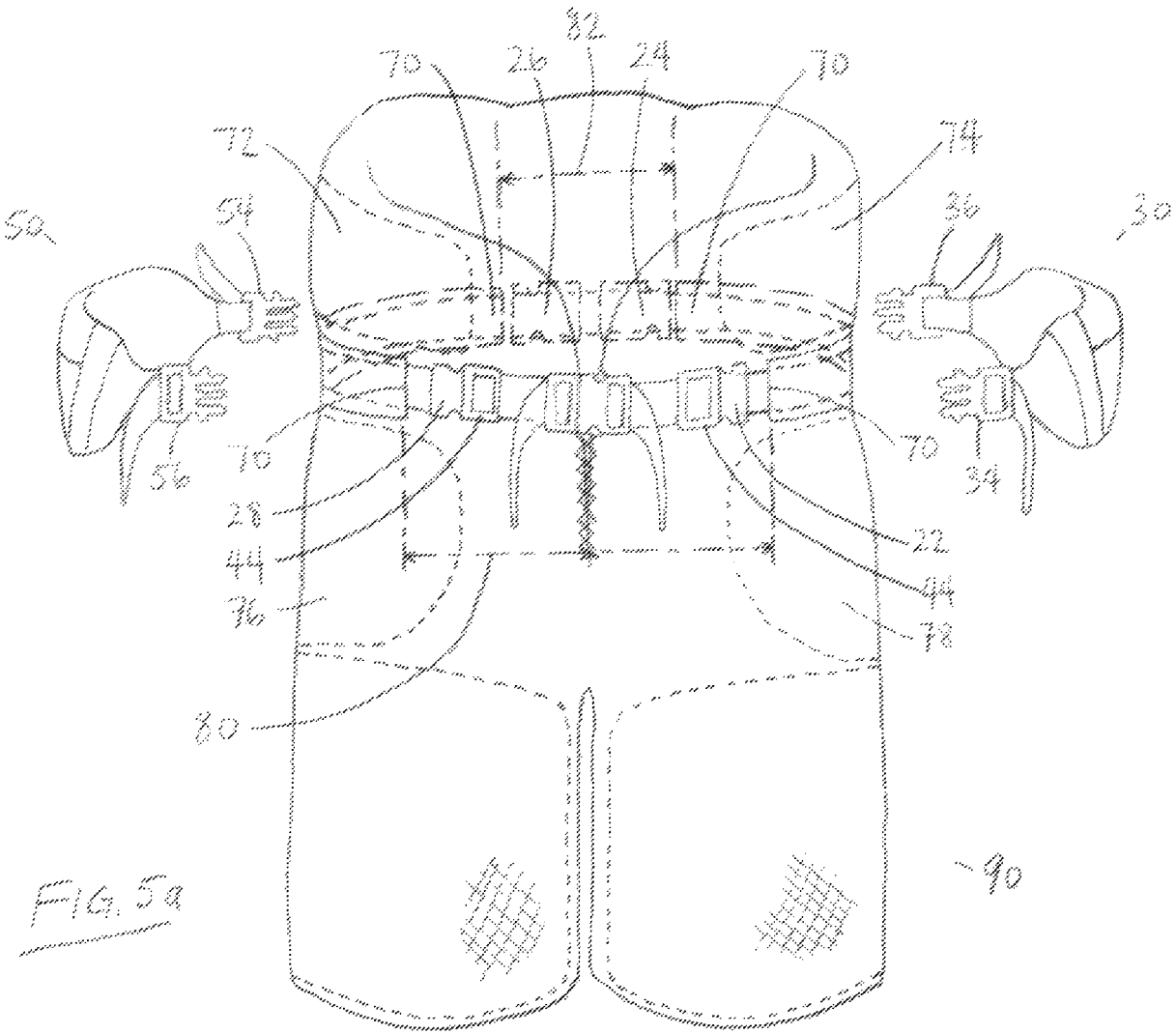
FIG. 5*a* is a perspective view from the front of the base belt portion of the weighted training belt made in accordance with the present invention integrated into a pair of hockey pants before weight pouches are attached.

FIG. 5*a*, shows base belt 12 as integrated into a pair of protective hockey pants 90 of a type commonly worn by hockey players. Said base belt 12 replaces the belt and fastener (not shown) commonly found in hockey pants. Said base belt 12 is housed in a belt loop structure 70 similar to the belt loop structure commonly found in hockey pants. Said belt loop structure 70 is horizontally disposed between the pads 72, 74 protecting the player's lower torso and hips 76, 78. Said belt loop structure 70 has an opening at the front of the pants 80 to provide access to the Central Buckle and two female receiving members 22, 28 contained at the front of the belt to either side of the Central Buckle, and an opening at the back of the pants 82 to allow access to the two female receiving members 24, 26 located there. When the weight pouches are not being used, said base belt functions as any other belt commonly found in hockey pants, allowing for the weight of the pants themselves to be supported on the hips of the user and for the adjustment of the length of the belt to accommodate a variety of users. When the training weight is being used, the base belt supports the weight pouches and the training weight in position on the hips of the user.

Figure 5B:
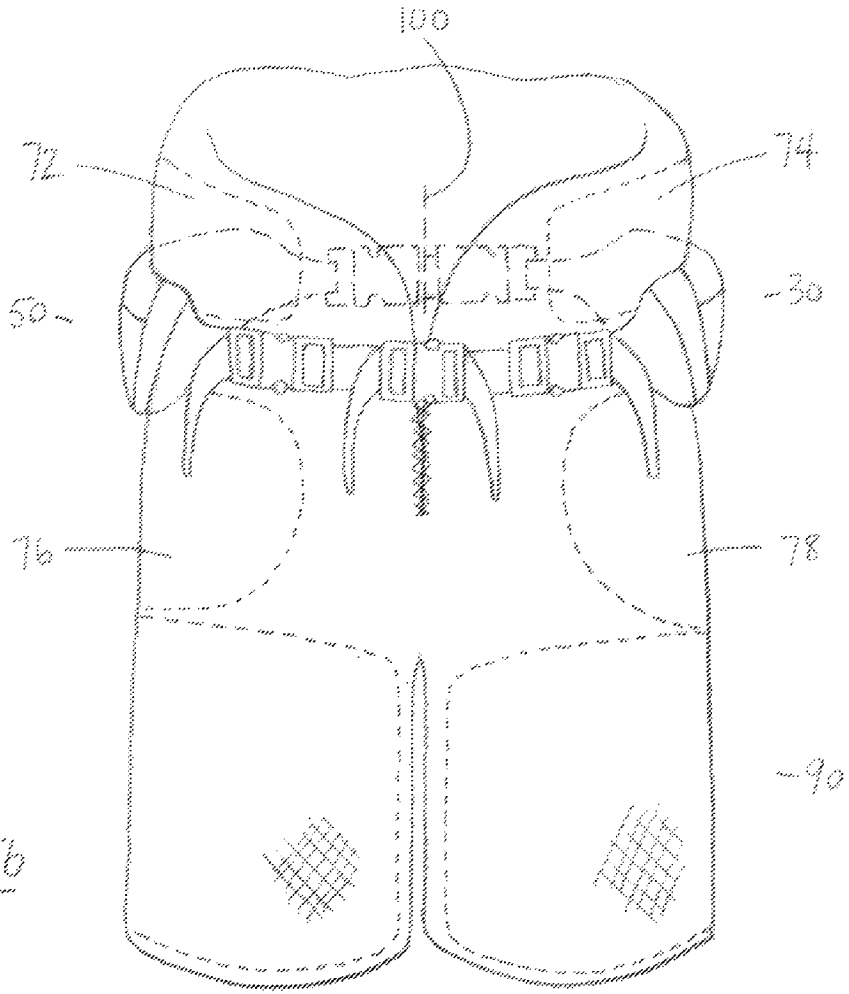
FIG. 5*b* is a perspective view from the front of the weighted training belt made in accordance with the present invention integrated into a pair of hockey pants with weight pouches attached.

FIG. 5*b* shows the Weight Pouches 30, 50 properly positioned on the pads 72, 74, 76, 78 of the pants protecting the user's hips and lower torso. When the base belt 12 is integrated into the pants as seen if FIGS. 5*a* and 5*b*, the base belt 12 is sewn at its midpoint 100 to the pants preventing the belt from moving on the waist of the user.

Figure 6:
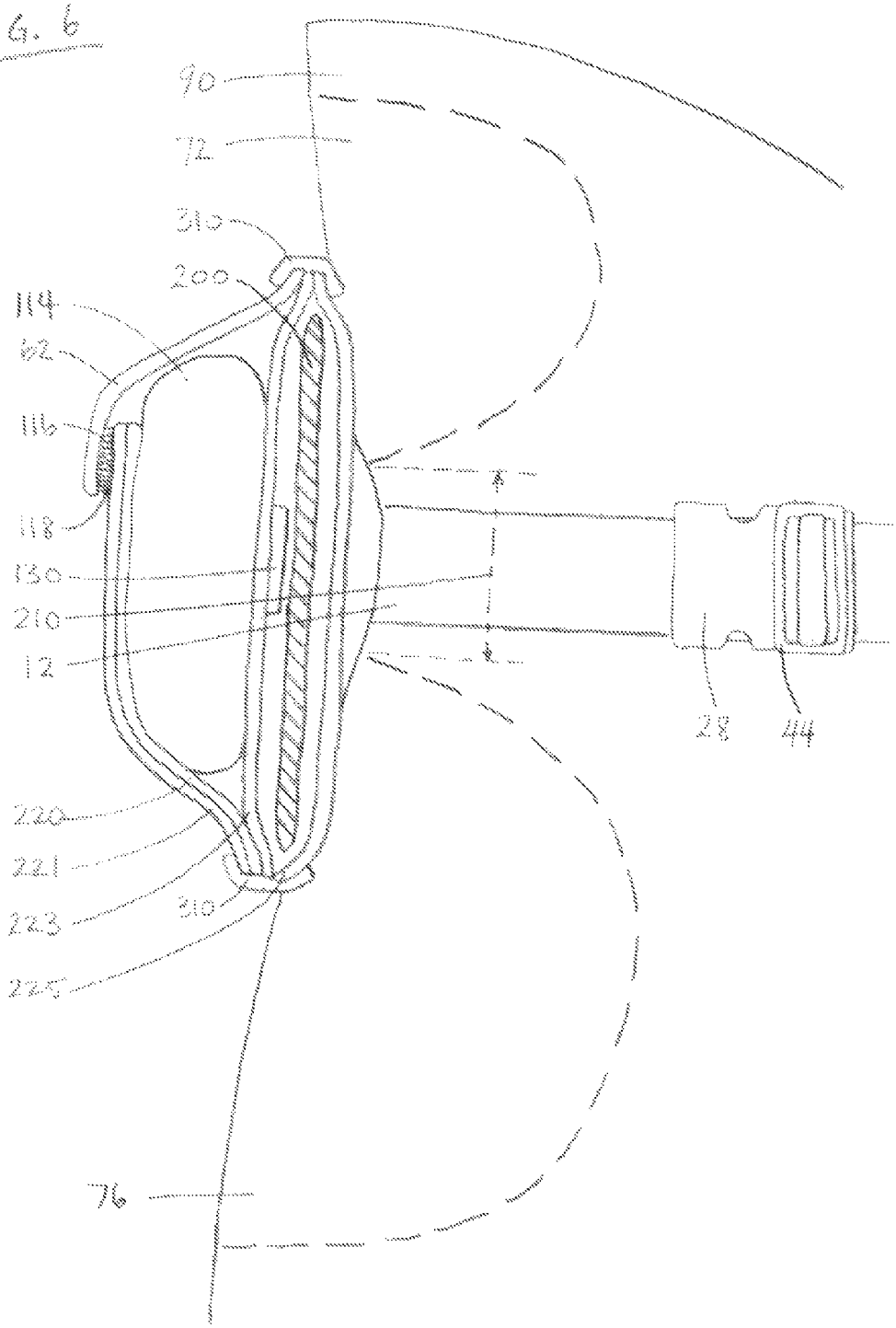
FIG. 6 is a cross section of the weight pouch along the line 3-3 in FIG. 3*b*.

FIG. 6 shows a cross section of the weight pouch along the line 3-3. Rigid member 200 is preferably a molded plastic insert which is incorporated into each Weight Pouch 30, 50. Rigid member 200 helps to transfer any pressure applied to the pouches (resulting from a fall or bodily contact with another player) to the pads of the protective hockey pants 90. Protective hockey pants 90 have pads 74 protecting the lower torso and hip pads 78 which are separated from each other by gap 210 at the waist. Preferably rigid member 200 is dimensioned to span gap 210 to permit the pouch to contact both pads 74 and 78 thereby transferring the force of any impact onto said pads minimizing the risk of injury.

Figure 7:
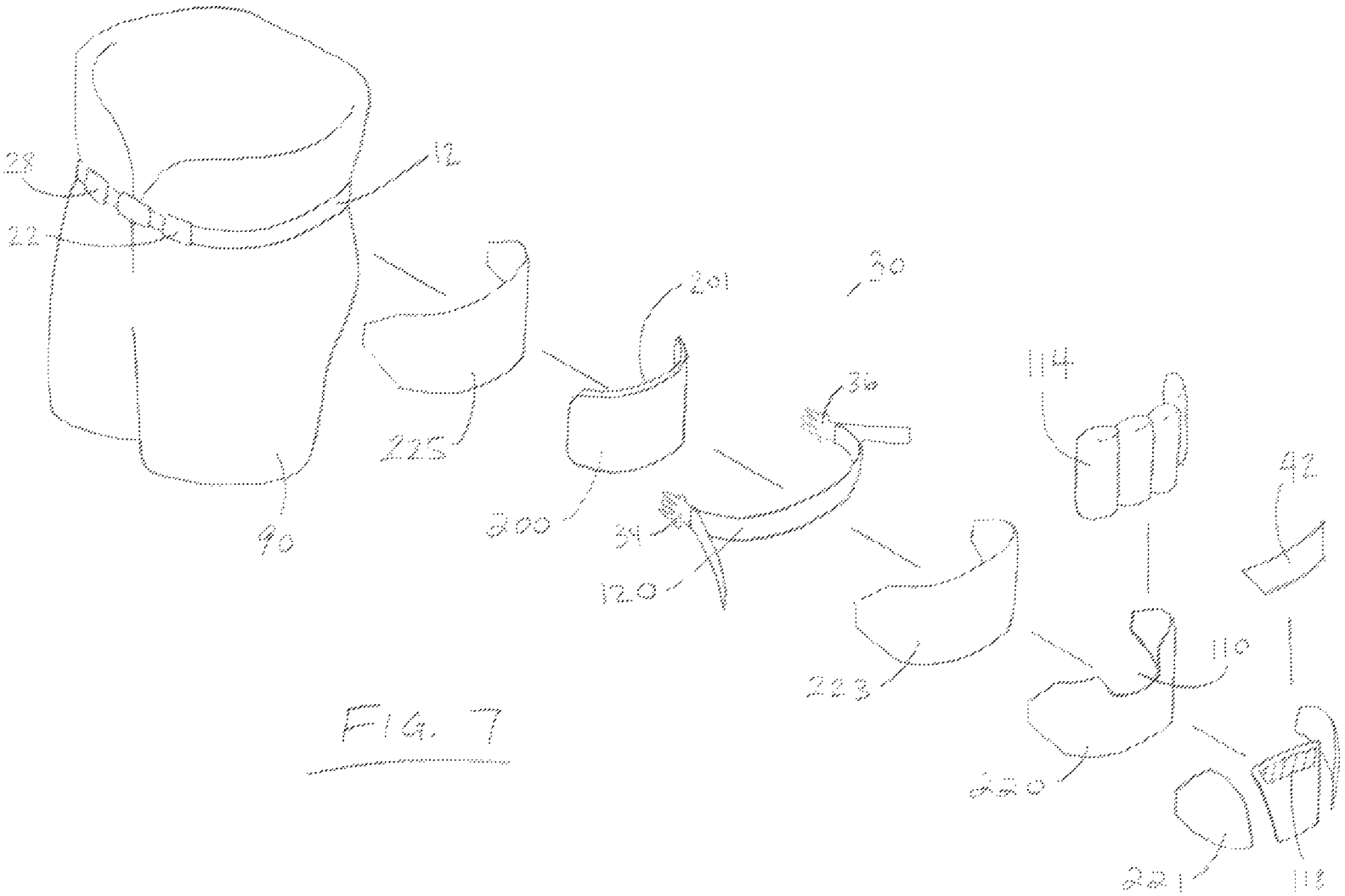
FIG. 7 is an exploded view of a weight pouch portion of the present invention.

Referring now to FIG. 7, the Weight Pouch 30 in the present embodiment is comprised of several fabric layers 221, 223, 225 of nylon or similarly durable fabric, one fabric layer 220 of a stretchy resilient fabric, nylon webbing 120 or the like and a rigid member 200. Rigid member 200 is preferably arch shaped and has a concave side 201 oriented towards belt 12. Rigid member 200 helps to give Weight Pouch 30 an arched profile permitting the pouch to fit closely to the wearer's waist. Rigid member 200 is preferably incorporated into the construction of Weight Pouch 30 between fabric layers 223, 225 which may be adhered together by stitching or by other means known generally in the art. Weight Pouch 30 preferably incorporates a stretchy resilient fabric layer 220 which is configured to permit the pouch to resiliently deform when weights 114 are inserted into the opening of the pouch pocket 110. The resiliency of fabric layer 220 is selected to permit the pouch to conform closely to the arched shape of the rigid member 200 to prevent portions of the pouch from sagging or hanging loose once the training weight 114 is inserted. A further layer of durable nylon fabric 221 is affixed on top of the stretchy resilient fabric layer 220 to protect the stretchy resilient fabric from tears or other damage. A protective binding ribbon 310 (see FIG. 9*a*) can be stitched around the outside edges of the fabric layers to protect the edges from wear and tear.

Training weights 114 are preferably elongated and flexible to permit the weights to conform closely to the arched profile of rigid member 200 when the weights are inserted into the pouch. Weights 114 may comprise elongated fabric envelopes filled with sand or some other suitable heavy material. Preferably, weights 114 should be sufficiently flexible to permit the weights to deform slightly in the event of a fall or collision thereby lessening the probability of an injury. The pouch is configured to hold weights 114 in a substantially vertical orientation when the training belt is worn. By mounting weights 114 in a vertical orientation it is easier for the weights to conform to the arched profile of the pouch.

Figure 8B:
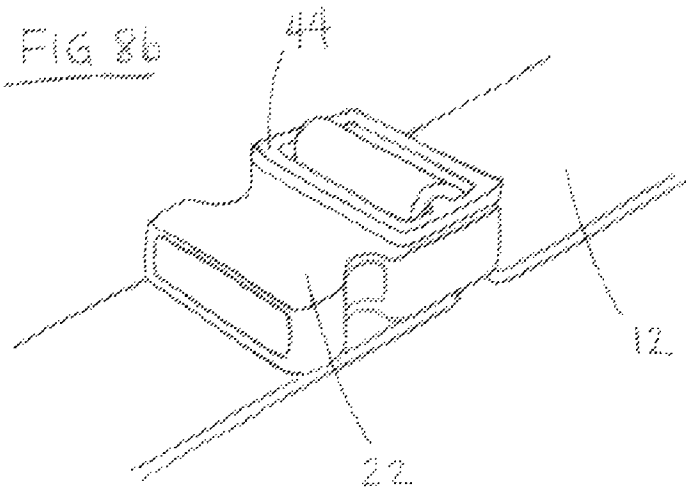
FIG. 8*b* is perspective view of the threading pattern of the base belt portion of the present invention through a female receiving member and a limit clip where the receiving member is locked in place on the base belt.
Figure 8A:
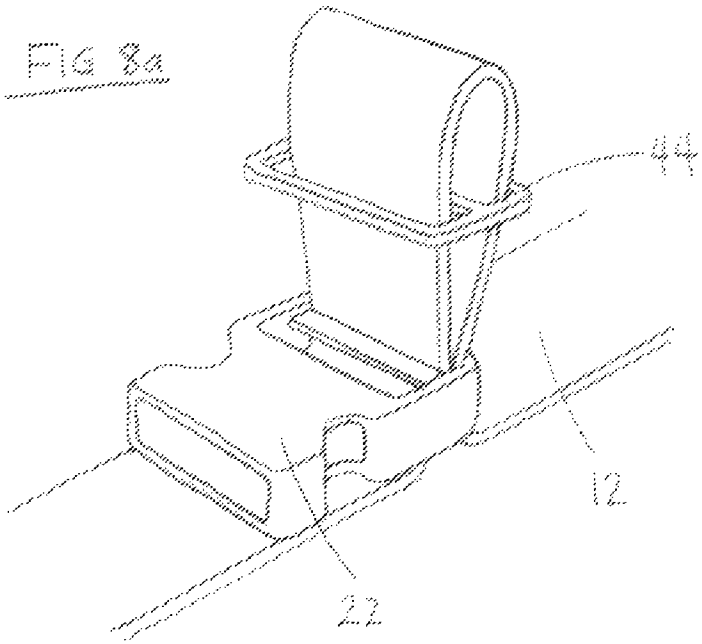
FIG. 8*a* is perspective view of the threading pattern of the base belt portion of the present invention through a female receiving member and a limit clip where the receiving member can slide along the base belt.

FIG. 8*a* shows the webbing threading pattern of base belt 12 through female receiving member 22 and limit clip 44 in the preferred embodiment. Removing slack from base belt 12 will lock receiving member 22 and limit clip 44 in place on the belt, as seen in FIG. 8*b*.

Figure 9B:
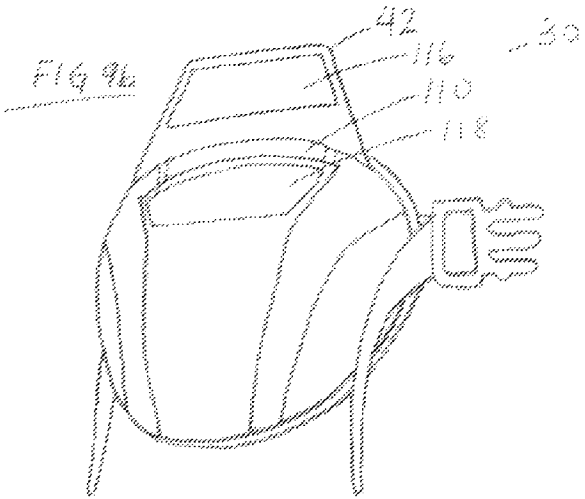
FIG. 9*b* is a perspective view of a weight pouch portion of the present invention showing the flap being open.
Figure 9D:
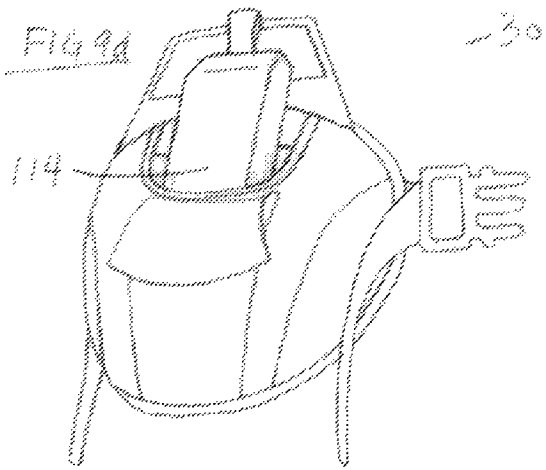
FIG. 9*d* is a perspective view of a weight pouch portion of the present invention showing the flap being open and the center panel of durable fabric which covers the outside of the pouch being pulled down and one of the weights pulled out of the pouch.
Figure 9A:
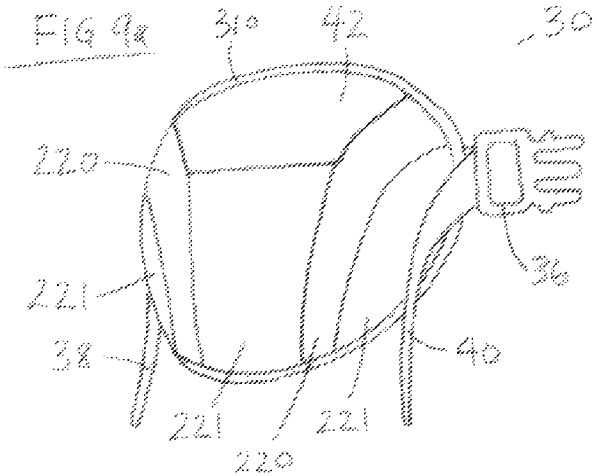
FIG. 9*a* is a perspective view of a weight pouch portion of the present invention showing the flap being closed.
Figure 9C:
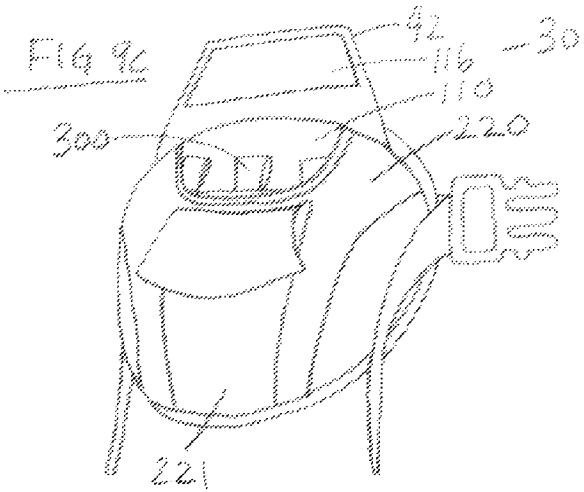
FIG. 9*c* is a perspective view of a weight pouch portion of the present invention showing the flap being open and the center panel of durable fabric which covers the outside of the pouch being pulled down to allow access to the pocket opening into which the training weight is inserted.

FIG. 9*a*, shows Weight Pouch 30 with a closed flap 42 containing weights 114. FIG. 9*b* shows said Weight Pouch with flap 42 open. Hook 116 and loop 118 tape are visible. FIG. 9*c* shows the center panel of the durable top layer of fabric 221 folded over to expose pouch pocket opening 110 in stretchy fabric layer 220 and the training weight 114 contained within said Weight Pouch. Pull tabs 300 can be affixed to the training weight to make removing the training weight from the Weight Pouch easier. FIG. 9*d* shows said training weight 114 partially removed from said pouch pocket opening. In this way can training weight be added or removed from said Weight Pouch in order to modify the intensity of a player's workout.

While the principles of the invention have been made clear in illustrative embodiments, there will be immediately obvious to those skilled in the art many modifications of structure, arrangement, proportions, the elements, materials, and components used in the practice of the invention, and otherwise, which can be particularly adapted to specific environments and operative requirements without departing from those principles. The appended claims are intended to cover and embrace any and all such modifications, with the limits only of the true spirit and scope of the invention.

What I claim is:

1. A hockey training belt for positioning a plurality of weights against a person's waist, said hockey training belt comprising:

a. an elongated belt dimensioned to fit around the user's waist, said belt having a length, opposite first and second ends, and complementary first and second coupling members provided adjacent the first and second ends of the belt, respectively;

b. at least one pair of connector elements mounted to the belt and positioned between the first and second coupling members, said pair of connector elements each being movable along the length of the belt around the user's waist, each of said connector elements being lock-able on the belt along the length of the belt such that the connector elements do not move along the length of the belt when locked;

c. at least one weight pouch having opposite first and second sides, a side strap extending from each of said first and second sides, a connector element provided adjacent an end of each of the side straps, the connector elements of the weight pouch being complementary to the pair of connector elements on the belt, the weight pouch configured to support at least one weight, opposite side straps of the weight pouch each having an adjustable length which can be adjusted to keep the side straps sufficiently taut to remain parallel and concentric with the elongated belt and the weight pouch tight against the waist when the hockey training belt is worn and to permit the person to adjust the positioning of the weight pouches on the waist.

2. The hockey training belt of claim 1 wherein the weight pouches further comprise a rigid member positioned between the weights and the belt.

3. The hockey training belt of claim 2 wherein the rigid member has a concave side oriented towards the belt.

4. The hockey training belt of claim 1 wherein the weights are flexible.

5. The hockey training belt of claim 4 wherein the weights are each elongated and wherein the weight pouches are configured to support the weights in a substantially vertical orientation when the hockey training belt is worn.

6. The hockey training belt of claim 1 wherein the connector elements on the belt are quick connect connector elements.

7. The hockey training belt of claim 1 wherein the pouch has a resilient web configured to permit the pouch to resiliently deform to accommodate the weights contained in the pouch.

8. The hockey training belt of claim 2 wherein the pouch has a resilient web configured to permit the pouch to resiliently deform to accommodate the weights contained in the pouch.

9. The hockey training belt of claim 2 wherein the weights are flexible.

10. The hockey training belt of claim 9 wherein the weights are each elongated and wherein the weight pouches are configured to support the weights in a substantially vertical orientation when the hockey training belt is worn.

11. The hockey training belt of claim 2 wherein the connector elements on the belt are quick connect connector elements.

12. The hockey training belt of claim 2 for use with protective hockey pants having kidney and hip protection pads separated by a gap at the waist, the rigid member being dimensioned and configured to span the gap when the belt is worn.

13. The hockey training belt of claim 12 wherein the rigid member has a concave side oriented towards the belt.

14. The hockey training belt of claim 13 wherein the weights are elongated and flexible and wherein the weight pouches are configured to support the weights in a substantially vertical orientation when the hockey training belt is worn.

15. The hockey training belt of claim 14 wherein the rigid member has a vertical length of greater than about 2 inches.

16. The hockey training belt of claim 2 wherein the rigid member has a vertical length of greater than about 2 inches.

17. The hockey training belt of claim 1 wherein the hockey training belt is built into a pair of protective hockey pants.

18. The hockey training belt of claim 2 wherein the hockey training belt is built into a pair of protective hockey pants.

19. A hockey training belt for use with protective hockey pants having kidney and hip protection pads separated by a gap at the waist, the belt adding a plurality of weights to a person's waist, the belt comprising:

a. an elongated belt dimensioned to fit around the person's waist, the belt having opposite first and second ends, with complementary first and second coupling members provided adjacent the first and second ends of the belt, respectively thereon, a left and right pair of quick connect couples positioned between the first and second coupling members, the left and right pair of quick connect couples being movably adjustable on the belt and selectively fixable along the belt;

b. a right weight pouch having opposite side straps having a length and a quick connect coupling provided on an end of each of the opposite side straps, the quick connect couplings of the right pouch being complementary to the right pair of quick connect couples on the belt, the right weight pouch having an opening for containing one or more weights, the length of the opposite side straps of the right weight pouch being selectively adjustable;

c. a left weight pouch having opposite side straps having a length and a quick connect coupling provided on an end of each of the opposite side straps of the left weight pouch, the quick connect couplings of the left pouch being complementary to the left pair of quick connect couples on the belt, the left weight pouch having an opening for containing one or more weights, the lengths of the opposite side straps of the left weight pouch being selectively adjustable;

d. wherein the left and right weight pouches each further comprise a concave rigid member positioned between the weights and the belt, the concave rigid member being dimensioned and configured to span the gap when the belt is worn;

e. the right and left weight pouches being made of a resilient web configured to permit the pouches to resiliently deform to accommodate the weights contained in the pouches;

f. the lengths of the opposite side straps of the left and right weight pouches being adjustable to keep the side straps sufficiently taut to remain parallel and concentric with the elongated belt and the weight pouches tight against the waist when the hockey training belt is worn and to permit the person's to adjust the positioning of the weight pouches on the waist.

20. A hockey training belt for adding a plurality of weights to a person's waist, comprising:

a. an elongated belt having a length, opposite first and second ends, and complementary first and second coupling members provided adjacent the first and second ends of the belt, respectively;

b. a left and right pair of connector elements positioned between the first and second coupling members, the left and right pair of connector elements being movably adjustable along the length of the belt and selectively fixable along the length of the belt;

c. a right weight pouch having opposite side straps with a connector element provided on an end of each of the side straps, the connector elements of the right pouch being complementary to the right pair of connector elements on the belt, the right weight pouch configured to support at least one weight, the opposite side straps of the right weight pouch each having an adjustable length;

d. a left weight pouch having opposite side straps with a connector element provided on an end of each of the side straps, the connector elements of the left pouch being complementary to the left pair of connector elements on the belt, the left weight pouch configured to support at least one weight, the opposite side straps of the left weight pouch each having an adjustable length;

e. the lengths of the opposite side straps of the left and right weight pouches being adjustable to keep the side straps sufficiently taut to remain parallel and concentric with the elongated belt and the weight pouches tight against the waist when the hockey training belt is worn and to permit the person to adjust the positioning of the weight pouches on the waist.

* * * * *